US008079483B2

(12) United States Patent
Brozell et al.

(10) Patent No.: US 8,079,483 B2
(45) Date of Patent: Dec. 20, 2011

(54) CLOSURE WITH STOPPING MECHANISM

(75) Inventors: Brian Brozell, Maumee, OH (US); Kiran M. D'Silva, Evansville, IN (US); C. Edward Luker, Evansville, IN (US); J. Nathan Marret, Newburgh, IN (US); John D. Mitchell, Owensboro, KY (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 493 days.

(21) Appl. No.: 12/208,928

(22) Filed: Sep. 11, 2008

(65) Prior Publication Data

US 2010/0059519 A1 Mar. 11, 2010

(51) Int. Cl.
*B65D 41/04* (2006.01)
*B65D 41/34* (2006.01)

(52) U.S. Cl. ..... 215/216; 215/217; 215/330; 215/334

(58) Field of Classification Search ..... 215/216, 215/217, 330, 331, 334, 349
See application file for complete search history.

(56) References Cited

U.S. PATENT DOCUMENTS

| | | | | |
|---|---|---|---|---|
| D054,265 | S | 12/1919 | Hyatt | |
| 1,978,946 | A | 10/1934 | Horner | |
| D111,450 | S | 9/1938 | Windbiel | |
| D135,618 | S | 5/1943 | McIntosh | |
| D183,424 | S | 8/1958 | Goldberg | |
| 3,244,272 | A | 4/1966 | Beaman et al. | |
| 3,357,388 | A | 12/1967 | Dunn | |
| 3,376,991 | A | 4/1968 | Deaver | |
| 3,471,052 | A | 10/1969 | Atkins | |
| D220,169 | S | 3/1971 | Lundberg | |
| 3,581,926 | A | 6/1971 | Roder | |
| D221,520 | S | 8/1971 | Plummer | |
| 3,888,373 | A | 6/1975 | Gach et al. | |
| 3,917,097 | A | 11/1975 | Uhlig | |
| 3,927,783 | A | 12/1975 | Bogert | |
| 3,949,893 | A | 4/1976 | Uhlig | |
| 3,958,708 | A * | 5/1976 | Le Brun, Jr. | 215/216 |
| 3,993,208 | A | 11/1976 | Ostrowsky | |

(Continued)

FOREIGN PATENT DOCUMENTS

CH 613907 10/1979

(Continued)

OTHER PUBLICATIONS

U.S. Patent and Trademark Office (ISA/US); International Search Report and the Written Opinion of the International Searching Authority, or the Declaration; Oct. 23, 2009; pp. 1-10; U.S. Patent and Trademark Office; U.S.

(Continued)

*Primary Examiner* — Mickey Yu
*Assistant Examiner* — Niki Eloshway
(74) *Attorney, Agent, or Firm* — Chad D. Bruggeman; John F. Salazar; Middleton Ruetlinger

(57) ABSTRACT

A closure having a stopping mechanism whereby a stop lug is positionable between a flexed and unflexed position relative to a spring gap. The stop lug may project from a skirt of the closure top wall. The spring gap is positioned adjacent the stop lug to provide an area for the stop lug to travel when outside forces are applied to the stop lug and subsequently return back to the unflexed position. The stop lug may have a substantially vertical support rib in combination with a plurality of annularly spaced ribs.

14 Claims, 11 Drawing Sheets

U.S. PATENT DOCUMENTS

| | | | | | |
|---|---|---|---|---|---|
| 4,006,837 | A | | 2/1977 | Gates et al. | |
| 4,078,687 | A | | 3/1978 | Zapp | |
| 4,099,639 | A | | 7/1978 | Boxer et al. | |
| 4,138,028 | A | | 2/1979 | Price et al. | |
| 4,213,534 | A | | 7/1980 | Montgomery | |
| 4,270,664 | A | | 6/1981 | Buono | |
| 4,280,632 | A | | 7/1981 | Yuhara | |
| 4,310,101 | A | | 1/1982 | Sekine | |
| 4,334,638 | A | | 6/1982 | Stock | |
| 4,335,823 | A | | 6/1982 | Montgomery et al. | |
| 4,345,690 | A | | 8/1982 | Hopley | |
| 4,381,840 | A | | 5/1983 | Ostrowsky | |
| 4,420,089 | A | | 12/1983 | Walker et al. | |
| 4,452,363 | A | | 6/1984 | Davis | |
| 4,572,388 | A | | 2/1986 | Luker et al. | |
| 4,588,097 | A | | 5/1986 | Hauser | |
| 4,620,640 | A | * | 11/1986 | Swartzbaugh | 215/217 |
| 4,630,743 | A | * | 12/1986 | Wright | 215/216 |
| 4,662,530 | A | | 5/1987 | Goncalves et al. | |
| 4,667,836 | A | | 5/1987 | McLaren | |
| 4,691,833 | A | | 9/1987 | Ahrens | |
| 4,756,435 | A | * | 7/1988 | Schick et al. | 215/216 |
| 4,832,220 | A | | 5/1989 | Quennessen | |
| 4,858,777 | A | | 8/1989 | Morel | |
| 4,930,647 | A | * | 6/1990 | Dutt et al. | 215/252 |
| 4,941,580 | A | | 7/1990 | Julian | |
| 4,967,921 | A | | 11/1990 | Pre et al. | |
| 5,160,057 | A | | 11/1992 | Fitjer | |
| 5,186,369 | A | | 2/1993 | Aguirrezabal | |
| 5,238,130 | A | * | 8/1993 | Marques et al. | 215/216 |
| D357,865 | S | | 5/1995 | Hansen | |
| D363,428 | S | | 10/1995 | Halm | |
| D368,225 | S | | 3/1996 | Bertolini et al. | |
| 5,560,505 | A | | 10/1996 | Schneider et al. | |
| 5,667,089 | A | | 9/1997 | Moore | |
| 5,671,853 | A | * | 9/1997 | Herr | 215/216 |
| 5,687,863 | A | | 11/1997 | Kusz | |
| 5,779,072 | A | | 7/1998 | Krebs | |
| D399,417 | S | | 10/1998 | Meausoone | |
| D399,743 | S | | 10/1998 | Coon et al. | |
| 5,816,422 | A | | 10/1998 | Roig | |
| 5,836,466 | A | | 11/1998 | Briere et al. | |
| D404,303 | S | | 1/1999 | Webster | |
| D405,354 | S | | 2/1999 | Meausoone | |
| 5,899,361 | A | | 5/1999 | Durliat et al. | |
| 5,915,576 | A | * | 6/1999 | Robinson | 215/216 |
| 5,950,851 | A | | 9/1999 | Clodfelter et al. | |
| 5,988,413 | A | | 11/1999 | Nagel | |
| 5,992,656 | A | * | 11/1999 | Dujardin et al. | 215/44 |
| 6,105,801 | A | | 8/2000 | Minnette | |
| 6,112,921 | A | | 9/2000 | Robinson | |
| 6,152,315 | A | | 11/2000 | Montgomery | |
| 6,168,035 | B1 | | 1/2001 | McLelland | |
| D444,387 | S | | 7/2001 | Adachi et al. | |
| 6,343,705 | B1 | | 2/2002 | Minnette | |
| 6,382,445 | B1 | | 5/2002 | McCandless | |
| D476,563 | S | | 7/2003 | Brozell et al. | |
| D481,948 | S | | 11/2003 | Brozell et al. | |
| 6,640,987 | B2 | | 11/2003 | Vassallo | |
| 6,681,945 | B1 | | 1/2004 | Harrold | |
| 6,783,014 | B2 | | 8/2004 | Luker | |
| 6,802,428 | B2 | | 10/2004 | Ekkert | |
| 6,854,613 | B2 | | 2/2005 | Biesecker et al. | |
| 6,866,164 | B2 | | 3/2005 | Branson et al. | |
| 6,871,752 | B2 | | 3/2005 | Montgomery | |
| D525,526 | S | | 7/2006 | Abbott et al. | |
| D528,419 | S | | 9/2006 | Robinson | |
| D537,201 | S | | 2/2007 | McLeish et al. | |
| 2002/0185464 | A1 | * | 12/2002 | Luker | 215/334 |
| 2005/0055986 | A1 | | 3/2005 | Brozell et al. | |
| 2005/0115917 | A1 | * | 6/2005 | Odet et al. | 215/349 |
| 2005/0121406 | A1 | | 6/2005 | Brozell et al. | |
| 2006/0108312 | A1 | | 5/2006 | Robinson | |
| 2006/0213860 | A1 | | 9/2006 | Robinson | |
| 2007/0284331 | A1 | * | 12/2007 | Miota et al. | 215/320 |

FOREIGN PATENT DOCUMENTS

| | | |
|---|---|---|
| CH | 619665 | 10/1980 |
| DE | 3804579 | 1/1989 |
| FR | 1507246 | 11/1966 |
| GB | 2303119 | 2/1997 |
| JP | 9154918 | 6/1997 |
| JP | 2007-223624 | 9/2007 |

OTHER PUBLICATIONS

U.S. Patent and Trademark Office (ISA/US); International Search Report and the Written Opinion of the International Searching Authority, or the Declaration; Nov. 3, 2009; pp. 1-11; PCT/US09/056669; U.S. Patent and Trademark Office; U.S.

* cited by examiner

CLOSURE WITH STOPPING MECHANISM

TECHNICAL FIELD

The present invention relates to a closure and particularly to a closure with a stopping mechanism.

DETAILED DESCRIPTION

Figure 1:
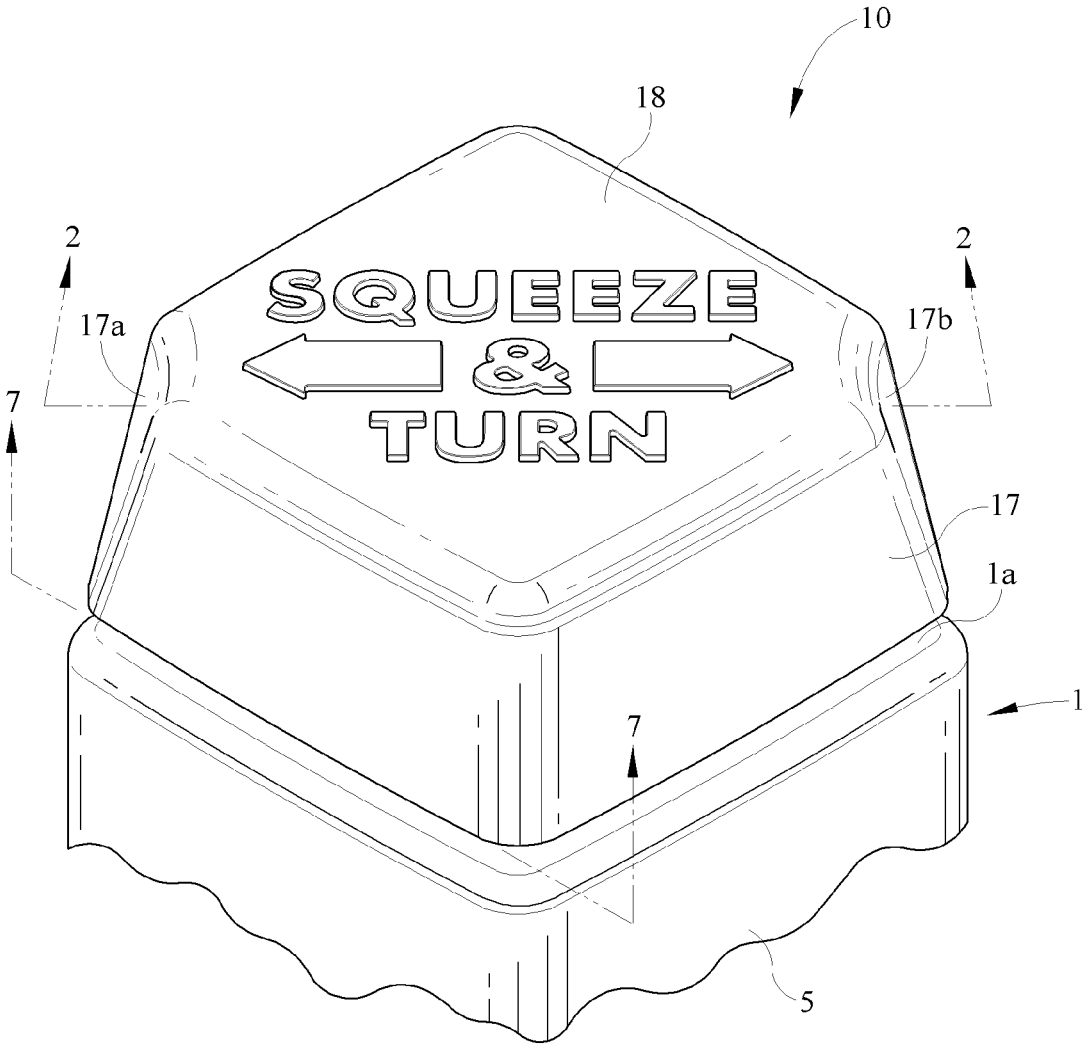
FIG. 1 shows a top perspective view of an embodiment of a closure, with portions of the container partially broken away.
Figure 1A:
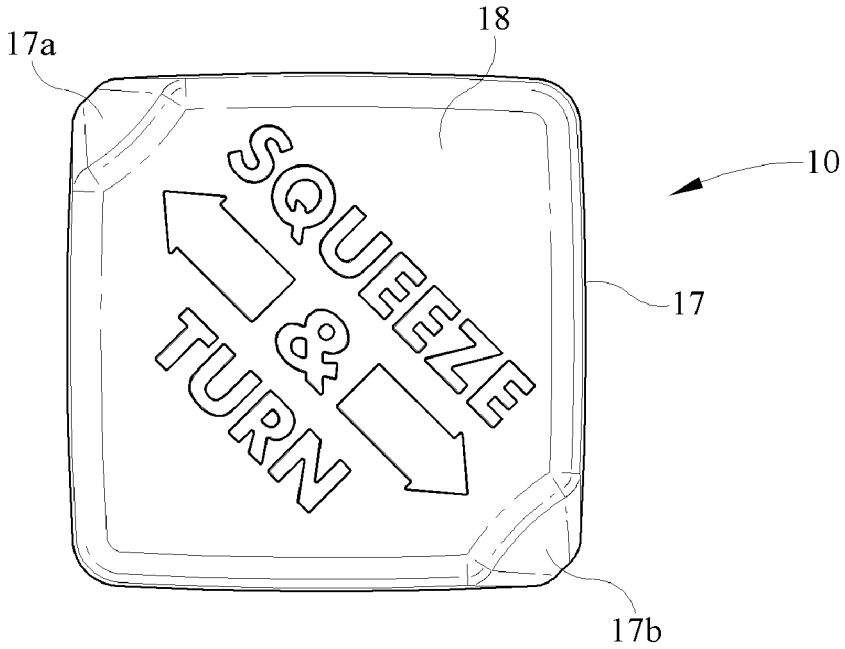
FIG. 1A shows a top view of the closure embodiment of FIG. 1.
Figure 1B:
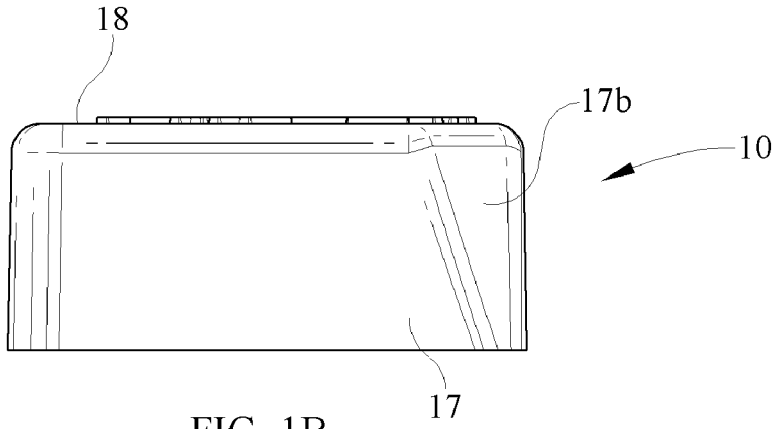
FIG. 1B shows a front view of the closure embodiment of FIG. 1.
Figure 1C:
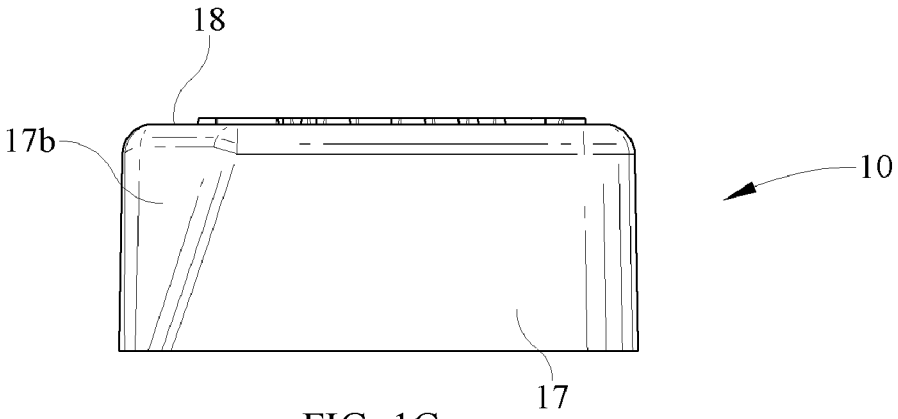
FIG. 1C shows a right side view of the closure embodiment of FIG. 1.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring to FIGS. 1-10, a closure 10 utilizing a stopping mechanism 60 with a container 1 is illustrated as a child resistant closure, but other closures, such as pull/push closures or either dispensing or non-dispensing, closures may be provided in any number of different shapes and sizes and still utilize the stopping mechanism 60 which comprises a stop lug 40 and a spring gap 20. Closure 10 may engage a container neck 2 of container 1 by a variety of means which function to make closure removable or non-removable from container 1 as known in the art. Closure 10 may be formed of a rigid or semi-rigid polymeric material such as polyethylene, polypropylene, or some other material commonly known to one of ordinary skill in the closure art. Moreover, closure 10 may be formed in a variety of sizes and shapes depending on the desired use of the closure and container associated therewith. As will be recognized by those skilled in the art, a variety of tamper indicating means or devices may also be used with closure 10.

Figure 3:
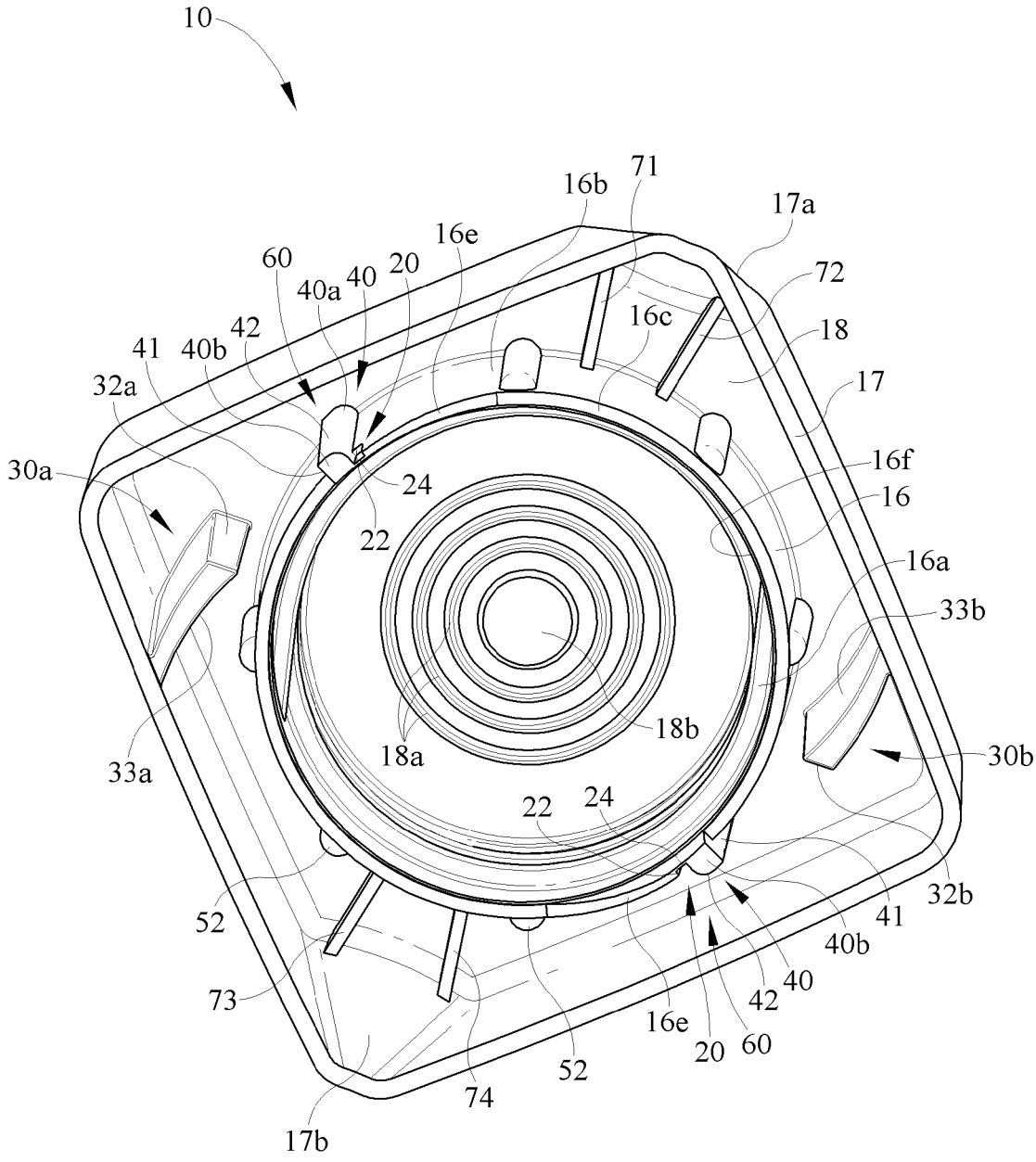
FIG. 3 shows a bottom perspective view of the closure of FIG. 1, with the liner removed.
Figure 4:
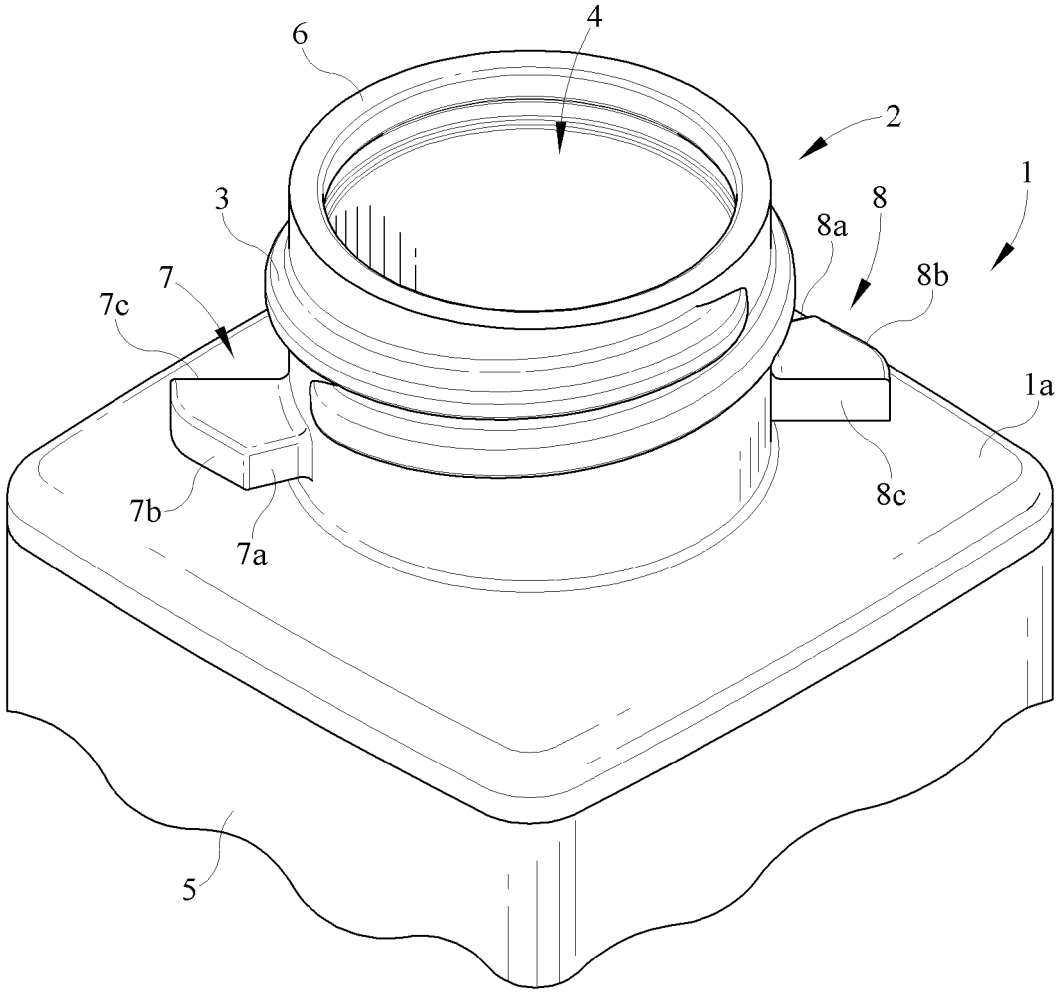
FIG. 4 shows a top perspective view of the container of FIG. 1, with portions of the container partially broken away.
Figure 5:
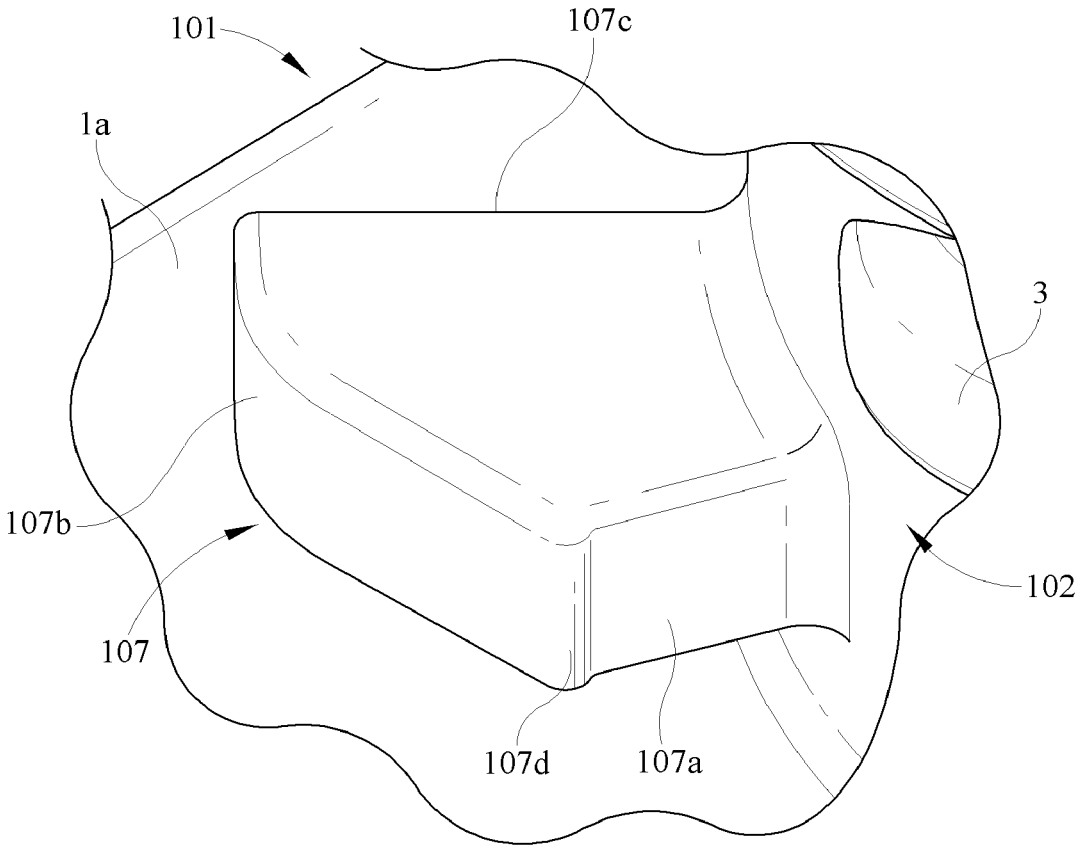
FIG. 5 shows an enlarged, top perspective view of another embodiment of the container of FIG. 1.

As shown in FIGS. 1-10, closure 10 may comprise an inner skirt or shell 16 and an outer skirt or shell 17, both depending from a top wall 18. Inner shell 16 is adapted to removably or fixedly receive the upper end or neck 2 of container 1. The interior surface of inner shell 16 includes suitable connecting means, such as a conventional thread 16*a* adapted for threaded engagement with mating container thread 3. At the top of neck 2 is an opening 4 permitting access to the contents of container 1. At least one child resistant container lug 7 is provided at the base of neck 2, adjacent the container shoulder 1*a*. Alternatively two such lugs 7 and 8 may be provided, on opposing sides of neck 2. Closure 10 is threaded axially upon container neck 2 until subsequent abutment of at least one child resistant container lug 7 engages or abuts at least one stop lug 40 of the closure. Stop lug 40 and spring gap 20 may act as a barrier to prevent closure 10 from being seated too far down upon container neck 2; it may also be used to align or orient the closure with respect to a label, instructions, symbols, tamper-indicating mechanisms, latch or hinge mechanisms, a particular container side such as a front side 5 of container 1, or to orient the closure relative to the container's shape (FIG. 1). Specifically when closure 10 is rotated clockwise onto the threaded container neck 2 of container 1, stop lug 40 depending from inner shell 16 is threaded down to the point where stop lug 40 engages with the corresponding and interfering container lug 7. Upon being seated as desired on container neck 2, closure 10 will be properly oriented with respect to container 1 because of the corresponding stop lug with spring gap and container lug engagement. The position of engagement of stop lug 40 and container lug 7 may be varied to insure that closure 10 will be oriented properly relative to container 1. Outer shell 17 may be designed with a variety of shapes and sizes, including a shape which is the same as inner shell 16. However as shown in FIGS. 1 and 1A-1C, outer shell 17 may also be shaped to conform to the shape of container 1, which in the embodiment illustrated is substantially square. Although container 1 is shown in detail in FIGS. 1, 2, 4, 7, 8, and 9, it is merely representative of containers and container finishes in general, and it is to be understood that there are a variety of containers of different shapes, sizes, and neck finishes that may be used with the closure embodiments herein. For example another embodiment of a container 101 is shown in FIG. 5, a container neck 102 includes a container lug 107. Container lug 107 has a stop face 107*a* with a vertical rib 107*d*, as more fully described below, adjacent to the cam surface 107*b*. A child resistant face 107*c* is spaced from stop face 107*a*.

Figure 2:
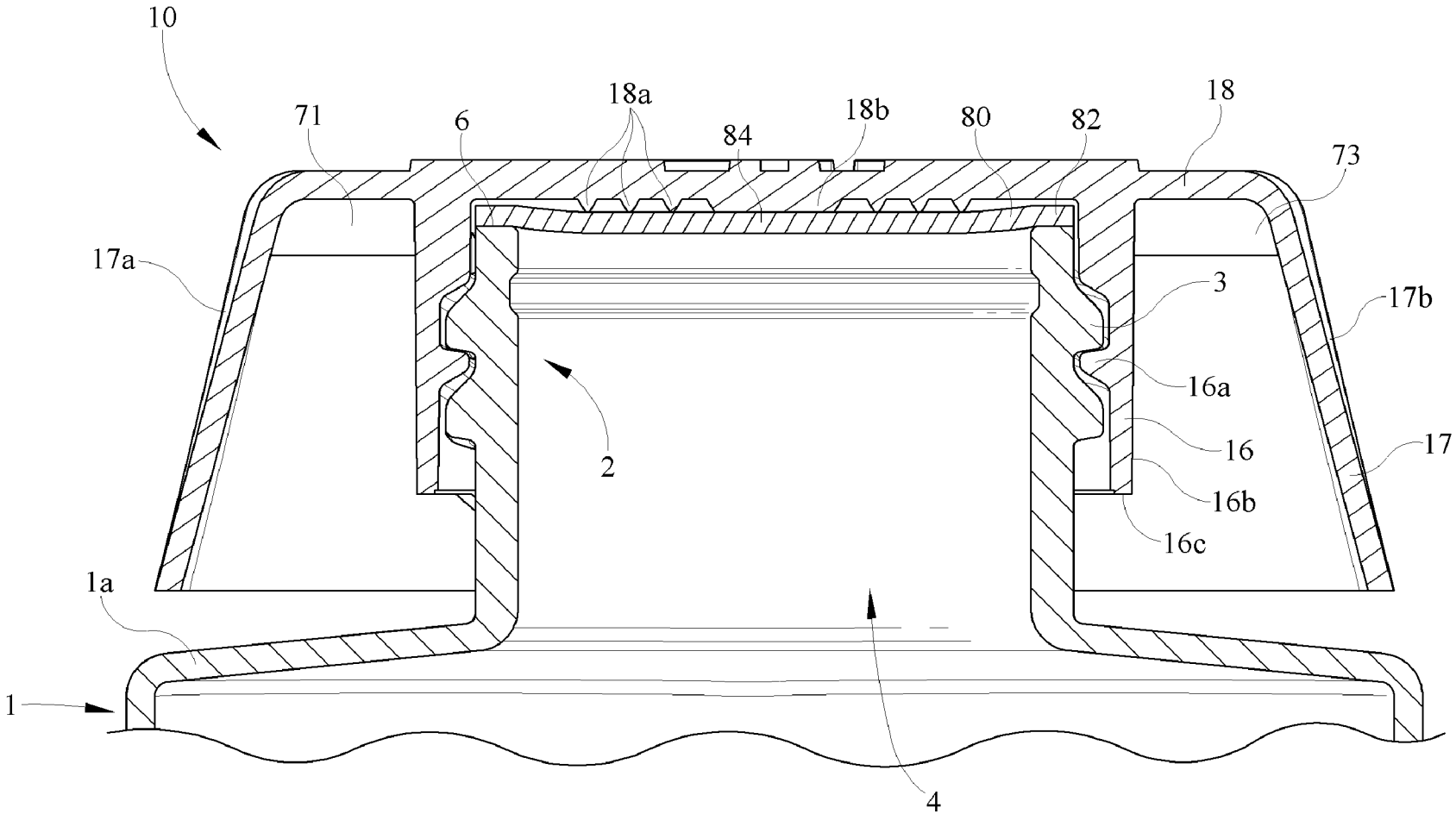
FIG. 2 shows a sectional view of the closure embodiment of FIG. 1 taken along line 2-2.

Additionally, the position of engagement of stop lug 40 with container lug 7 may in some cases limit the axial distance traveled by closure 10 along container neck 2, so that a clearance will be left between top wall 18 and container lip 6, which could allow leakage from inside container 1. To prevent such leakage, as shown in FIGS. 2 and 7-10, a liner 80 may be positioned inside closure 10 to initially seal container lip 6, and may be used to re-seal the container lip upon subsequent closings. Liner 80 may be held within closure 10 before being applied to container neck 2. During assembly of the liner 80 and closure 10, center projection 18*b* absorbs the stress or forces applied to annular projections 18*a* to reduce deformation of the annular projections. Adhesives may be included to bond the liner to the closure during assembly. Additional annular projections may also be included to reduce deformation during the assembly of the liner to the closure. Liner 80 is preferably disc shaped and substantially flat prior to application to container neck 2. However as shown in FIG. 2, upon placement of closure 10 onto neck 2 during assembly, liner 80 may be positioned or domed into contact with container lip 6 by one or more projections downwardly depending from top wall 18, such as but not limited to annular projections 18*a* and a center projection 18*b*. Annular projections 18*a* are preferably V-shaped in vertical cross section. When screwing closure 10 onto neck 2, the central portion 84 of liner 80 will be forced downward by depending annular projections 18*a* and center projection 18*b* while an outer peripheral edge 82 of liner 80 is forced into engagement with the container lip 6. When liner 80 is fully engaged with the container lip 6, the central portion 84 may be offset from the outer peripheral edge 82 adjacent the container lip 6 as shown in FIG. 2. The use of projections 18*a*, 18*b* will consistently position liners 80 against the container lip or sealing surface for later induction or conduction welding to seal the package. Depending projections 18*a* and 18*b* will serve to compensate for the lack of over-travel of the aligned closure 10 relative to container 1 to consistently seal the container. Although annular projections 18*a* and center projection 18*b* is shown in specific detail in the figures, it should be understood that a variety of shapes, sizes, positions, and constructions may be used and still provide for consistent sealing of the container. It should also be understood that a plug seal (not shown) or a variety of different radial seals (also not shown) can be formed to depend from top wall 18 or skirt of closure body 10 in position to engage the interior or exterior of container neck 2 when closure 10 is engaged with container neck 2. In other words, when closure 10 is seated upon container neck 2 to the point where stop lug 40 and container lug 7 engage (FIG. 7), possibly to orient closure 10 to the shape of the container, a plug or radial seal can engage and seal the interior or exterior, above or below thread 3, of container neck 2. A plug or radial seal may serve to seal a linerless container from the time the contents are received into the container and the closure is applied and for the duration of the useful life of the container. Alternatively, closure 10 may accommodate, for example, a variety of types of liners including re-seal liners positioned to engage container lip 6, the use of malleable seal materials positioned along the inner surface of top wall 18, foil seals, retort seals, or other seals known to those skilled in the art. Seal retainers may also be used in various embodiments of the closure.

As described above and shown in FIGS. 3 and 6-10, one or more stop lugs 40 may project down from inner shell 16. A free end 40*b* of each stop lug 40 may extend along inner shell 16 and beyond a lower portion or termination edge 16*c* of inner shell 16. An abutment surface 41 is provided adjacent the bottom end 40*b* of stop lug 40, and which abutment surface 41 preferably has an increased surface area adapted to resist deformation as the rotational pressure increases once contact between stop lug 40 and container lug 7 occurs. A variety of shapes such as a reverse taper, as well as various positions, constructions, quantities, and dimensions of stop lug 40 may be used and still fall within the spirit of an embodiment of the invention. For example as shown in FIGS. 3, 6, and 7-10, stop lug 40 may include a support rib 42. Support rib 42 may extend from closure top wall 18 along inner shell 16 to the free end 40*b* of stop lug 40 or may vary in length whereby it extends only partially along the length of the inner shell. Support rib 42 normally extends outwardly from an outer surface 16*b* of inner shell 16. Support rib 42 serves to strengthen stop lug 40 as well as inner shell 16, and can increase the surface which may abut the container lugs without increasing the entire thickness of the inner shell. Support rib 42 may also function as an unscrewing lug during the molding process, or may be used in combination with a plurality of dedicated unscrewing lugs 52. Support rib 42 may be provided in a variety of sizes, shapes, positions, and constructions as for example extending from the inner shell to the outer shell, and in numbers to provide for support of all stop lugs 40.

As shown in FIGS. 3, 6, and 7-10, to reduce over-torque and subsequent over threading, inner shell 16 has a downwardly projecting stop lug 40 extending beyond terminating end 16*c*. Stop lug 40 is substantially resilient and in a relaxed, unflexed first state (FIGS. 3, 6, 7, 8, and 10) before engaging with the container lug 7. However, upon placement of closure 10 onto neck 2 during assembly, specifically when stop lug 40 initially engages a stop face 7*a* of container lug 7, stop lug 40 is deformed or positioned into a tensioned, flexed second state (FIG. 9) in which a bridge 24 of spring gap 20 positioned adjacent to each stop lug 40 is deformed allowing for stop lug 40 to substantially close spring gap 20 of the inner shell. Bridge 24 normally flexes and/or curves radially (FIG. 9) when deformed by stop lug 40; however bridge 24 may be designed to flex in a variety of directions or by a variety of means such as but not limited to annularly, vertically, or in combinations thereof Stop lug 40 is able to travel into spring gap 20 substantially towards or adjacent the abutment surface 16*d* of the external stop extension 16*e* of inner shell 16. External stop extension 16*e* is shown in FIGS. 3 and 6-10 as tapering into the terminating end 16*c* of inner shell 16. Thus, when closure 10 is threaded onto container neck 2 (FIGS. 1, 2, and 7-9), bridge 24 of spring gap 20 potentially may be compressed or deformed to the point where stop lug 40 is positioned substantially flush against abutment surface 16*d*, preventing the closure 10 from further rotation and traveling past the desired vertical and/or annular distance upon container neck 2. Further in the second state or flexed position (FIG. 9) of stop lug 40 and deformed bridge 24 of spring gap 20, each of stop lug 40 and bridge 24 of spring gap 20 has living memory urging the stop lug back toward its unflexed position. Thus the spring gap and/or the stop lug is capable of resisting permanent deformation, and thus may align or orient the closure relative to the position of container lug 7. This stopping mechanism 60 permits closure 10 to be assembled at varying torques and still assure that the closure is aligned relative to the container, and more specifically that child resistant lock 30*a* has cleared container lug 7 assuring the child resistant mechanism is properly engaged. As a result, the over travel allowance, typically 30 degrees, currently designed into closure and containers is decreased.

Figure 6:
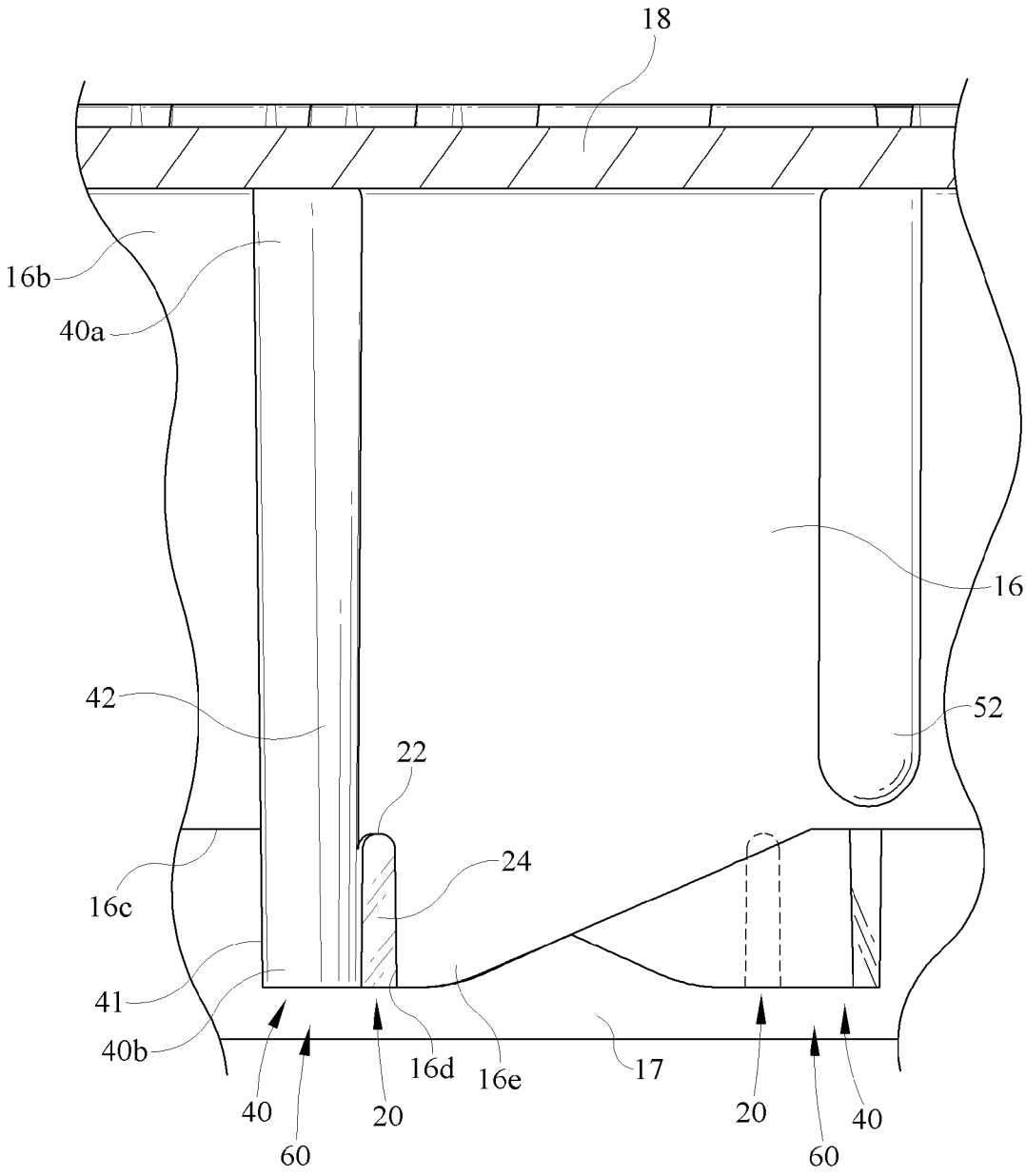
FIG. 6 shows an enlarged, side view of the closure of FIG. 3 with portions of the closure partially broken away.
Figure 7:
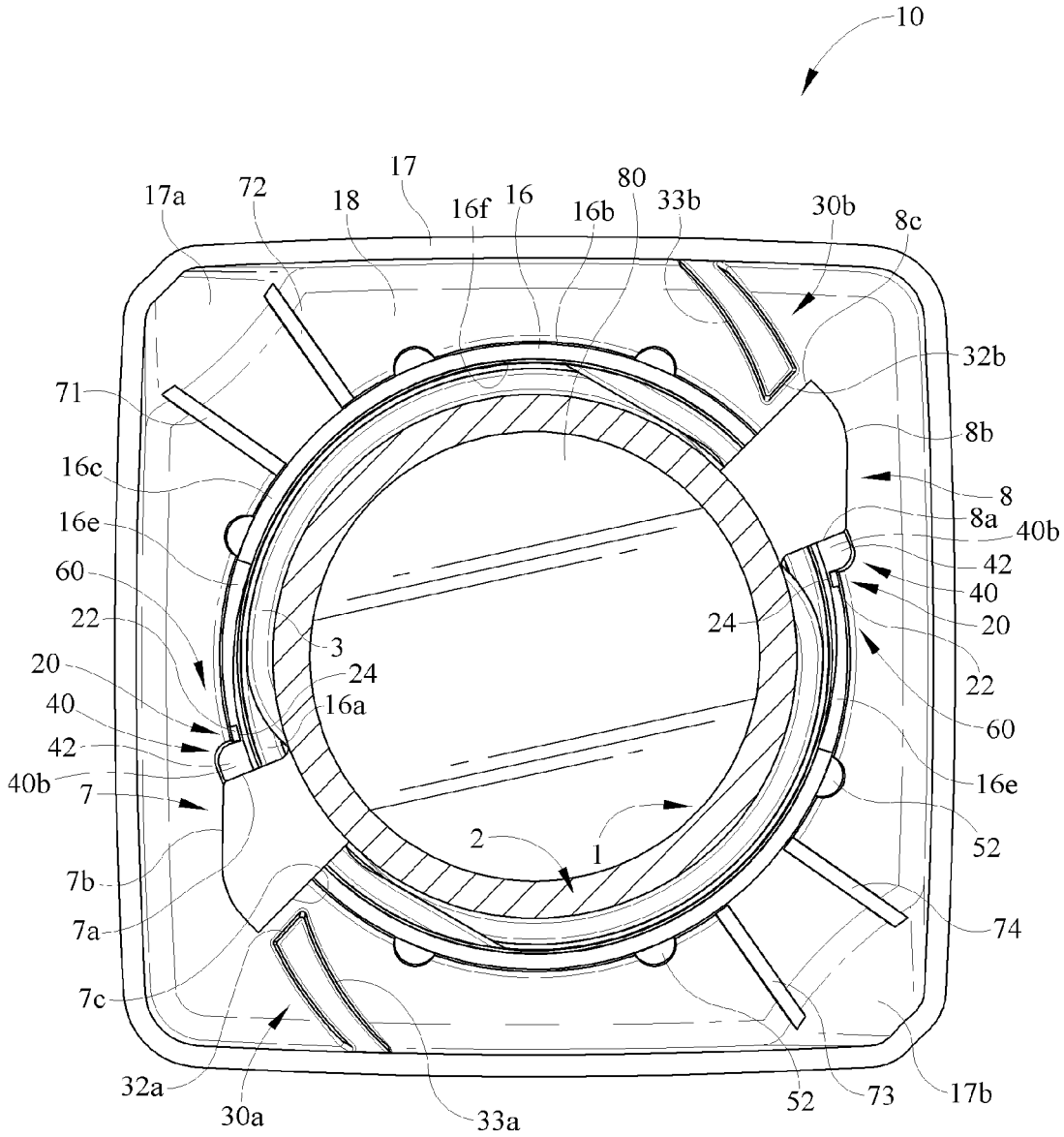
FIG. 7 shows a sectional view of the closure embodiment of FIG. 1 taken along line 7-7.
Figure 8:
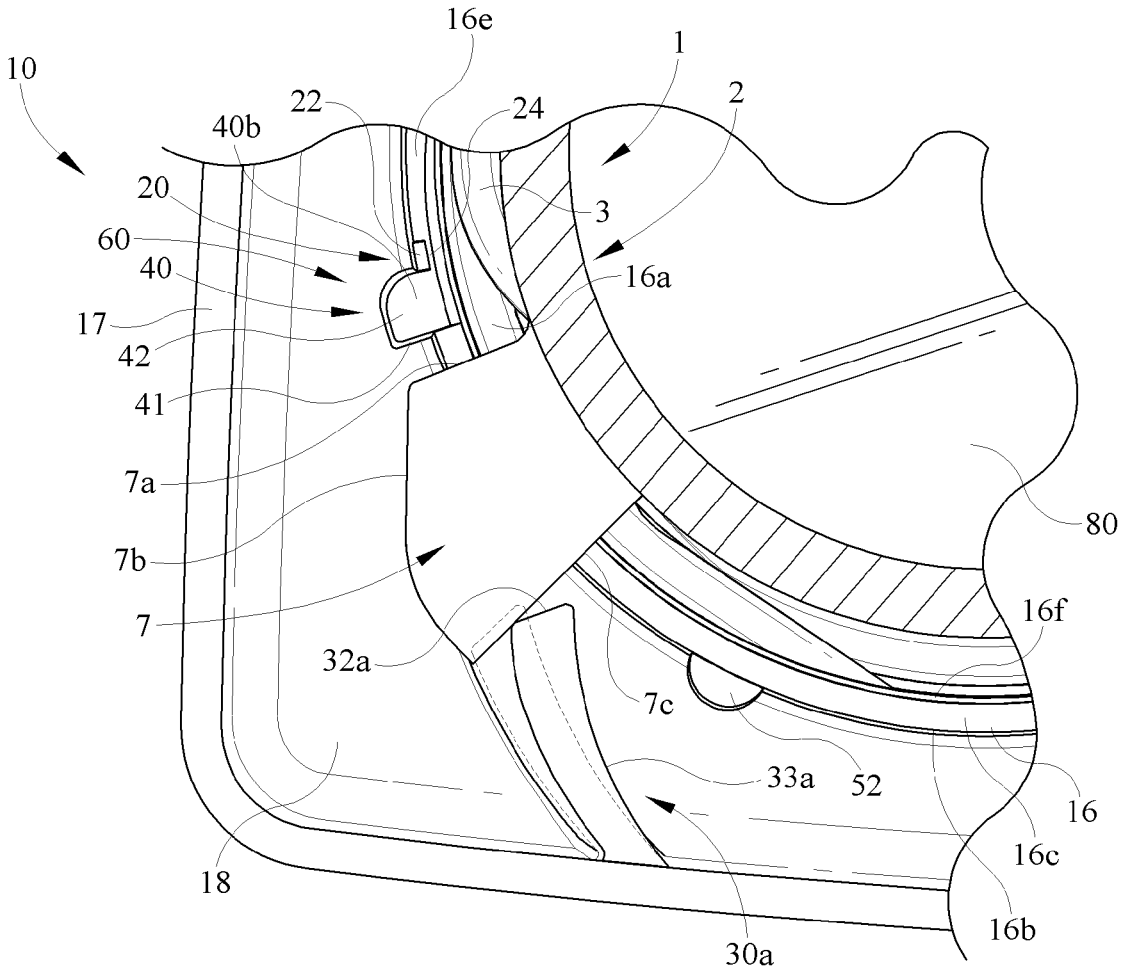
FIG. 8 shows an enlarged, sectional view of the closure embodiment of FIG. 7 illustrating the interaction of the child resistant lock of the closure with the container lug, the position of the child resistant lock before the safety feature is engaged is shown in broken lines.
Figure 9:
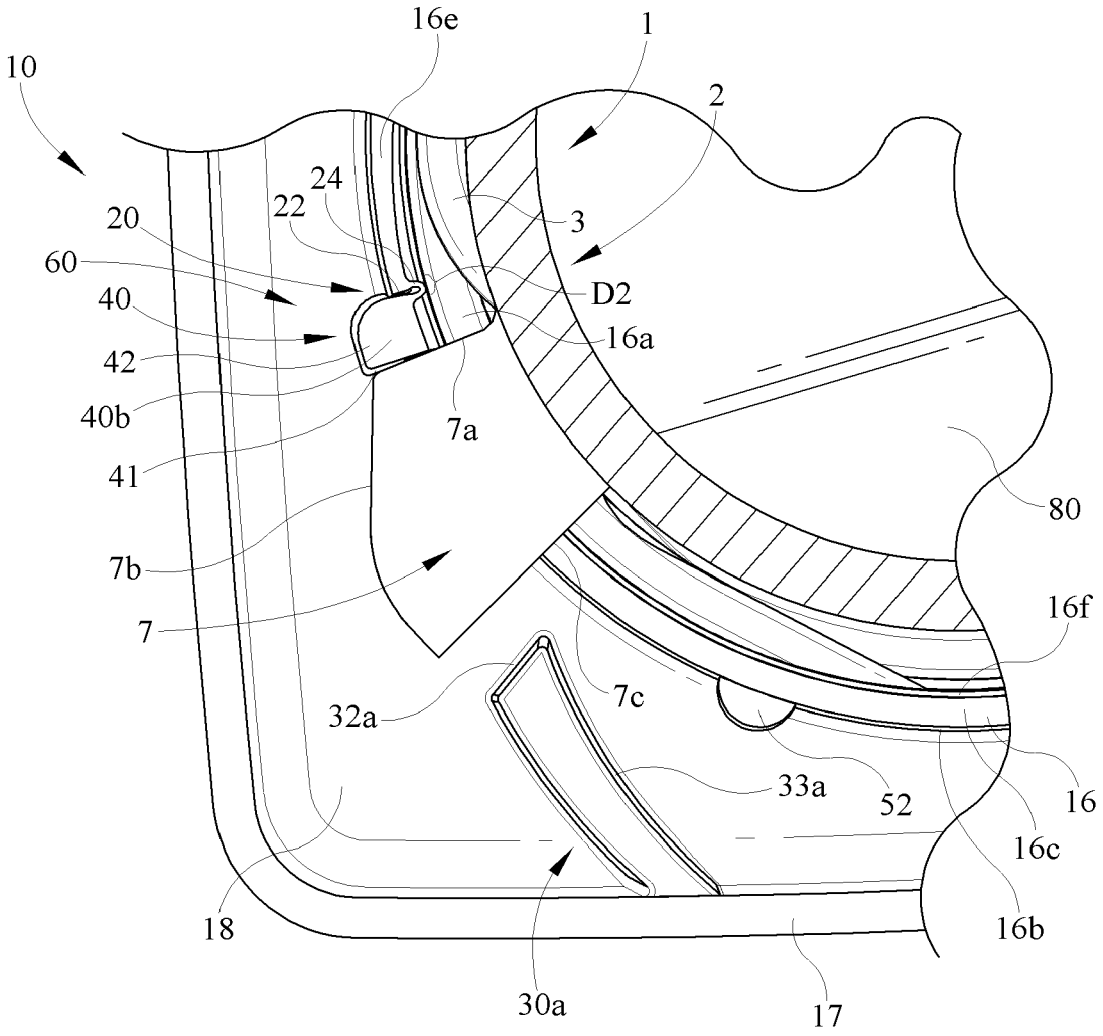
FIG. 9 shows an enlarged, sectional view of the closure embodiment of FIG. 7 illustrating the interaction of the stop lug of the closure with the container lug.
Figure 10:
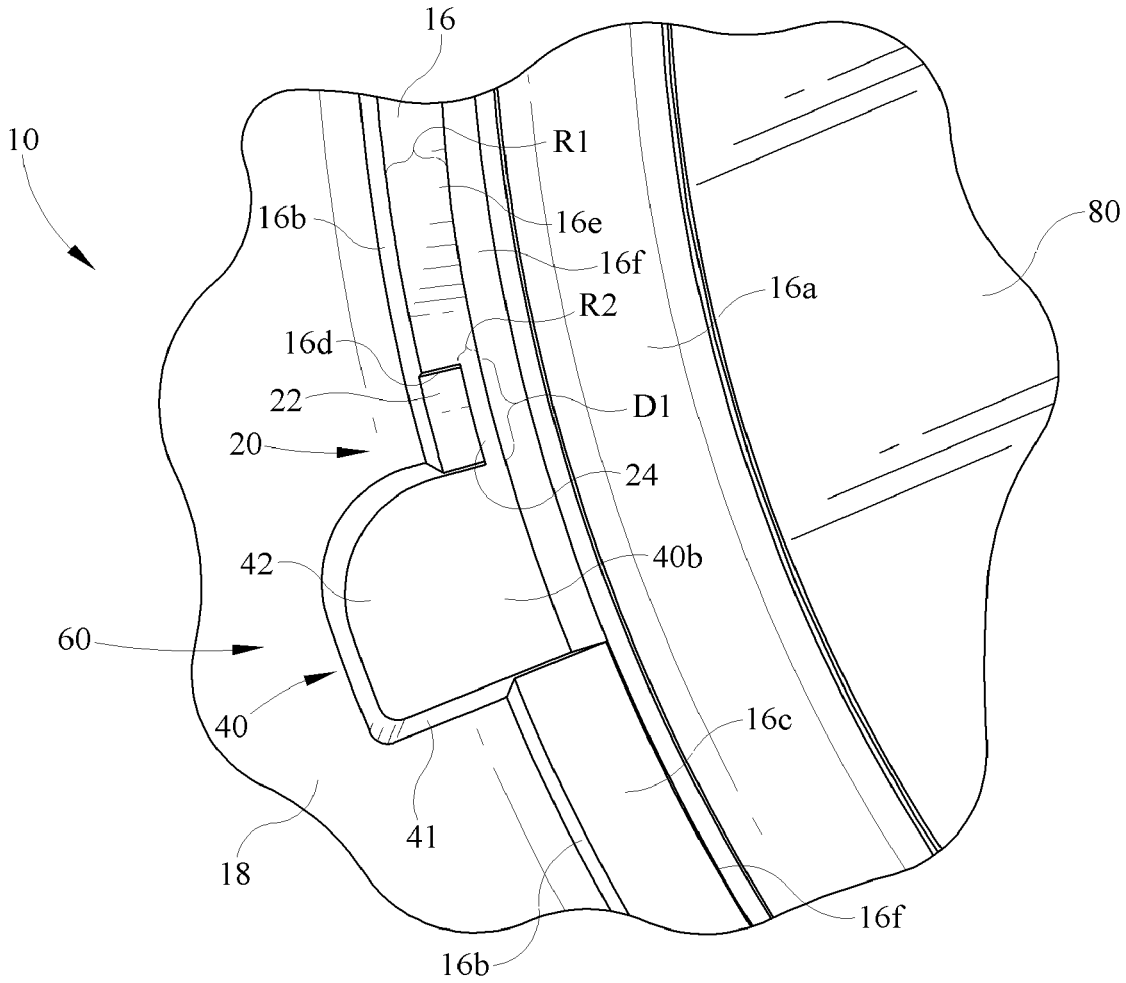
FIG. 10 shows an enlarged, bottom view of the closure embodiment of FIG. 3.

As shown in FIGS. 8 and 10, spring gap 20 has a first distance D1 in the unflexed position relative to closure stop lug 40. Spring gap first distance D1 can be reduced to a second distance D2 (FIG. 9) when stop lug 40 engages container lug 7 and rotational forces placed on the closure flexes the stop lug into the spring gap. As shown in FIG. 6, spring gap 20 has a recess 22 extending upwardly from terminating end 16*c* of inner shell 16 towards top wall 18. As shown in FIG. 10, recess 22 defines bridge 24 of a radial thickness R2, wherein the radial thickness R1 of inner shell 16 is larger than R2. The bridge 24 connects stop lug 40 to abutment surface 16*d* on the opposite side of the recess adjacent the external stop extension 16*e* of inner shell 16. Although recess 22 and spring gap 20 are shown in detail in the figures, it should be understood that each of the recess and/or spring gap may be provided in a variety of shapes, such as curved, wedged shaped, or tapered; in a variety of sizes such as differing lengths and cross sections; in a variety of constructions such as adjacent a closure CR lug (as shown); in a variety of positions such as spaced from drop lug 40 and/or support rib 42; and quantities, and still function to permit stop lug 40 to be positionable between its flexed (FIG. 9) and unflexed (FIGS. 3, 6, 7, 8, and 10) positions. For example, the recess may extend through the entire inner shell 16 from outer surface 16*b* to inner surface 16*f* of inner shell 16, or otherwise stated the entire radial thickness R1, and thus no bridge 24. Also the recess may extend from inner surface 16*f* instead of outer surface 16*b*, or both surfaces 16*f* and 16*b* leaving a bridge of material therebetween. Another example, the stopping mechanism may be positioned in the outer shell of a closure, or permit the functioning of a dispensing orifice of a closure. Also, the stop lug does not have to flex substantially annularly; it may flex in various other directions relative to the spring gap, including but not limited to vertically or radially, depending on the desired application of the closure. Also, a bias or guide mechanism directing or restricting movement of a stop lug may be used in the closure, however it should be understood that this structure is not limited to the closure and may be part of the container neck. For example as shown in FIG. 5, a vertical rib 107*d* provided on stop face 107*a* of container lug 107 may prevent outward radial movement of stop lug 40. Other examples of the use of a guide mechanism to direct movement of a stop lug may include shaping the stop face 107*a* of the container lug 107 so as to be angled or tapered back (not shown) into the container lug thereby guiding the stop lug 40 radially inwardly to create a more aggressive engagement between the closure stop lug and container lug when over-travel of the closure occurs.

The use of stop lug 40 with spring gap 20 reduces assembly complications at the time of initial application of closure 10 to container 1 and thru the repeated application of the closure to the container during the useful life of the container. Specifically, at the time of assembling closure 10 with container 1, the capping torque applied to the closure may be sporadic and is not a precisely controllable variable. In such case the use of spring gap 20 and stop lug 40 provides sufficient strength to resist over-torque during the capping process. Spring gap 20 thus reduces the potentially deleterious effects of over-torque, for example, preventing the over tightening of the closure and reducing the potential breakage of stop lugs; it also serves to consistently orient or rotate the closure in relation to the container.

It should be understood that a variety of other structures may be utilized with the stopping mechanism 60 having stop lug 40 and spring gap 20, such as and not limited to closure child resistant locks 30*a* and 30*b* (FIG. 3) or tamper indicating devices (not shown), in the embodiments of the invention, but these other structures are not necessary to utilize the other inventive features of the present embodiments. Any number of safety features known in the art may be used in an embodiment of the present invention. For example as shown in FIGS. 3 and 6-8, child resistant locks 30*a* and 30*b* may be provided to work in combination with stopping mechanism 60 in order to provide child resistant features in the closure. As shown in FIGS. 2 and 3, a double-walled "squeeze and turn" safety closure may be utilized, however a variety of single or double-walled closures may be provided within the scope of this invention. Closure 10 has a deformable annular outer shell 17 depending from top wall 18. Outer shell 17 may be straight or tapered. Opposing squeeze pads 17*a* and 17*b* are formed on the corners of the square shaped outer shell 17, spaced at about 180 degrees, to provide a guide for the proper location to apply pressure to deform shell 17 in order to overcome the safety features preventing removal of closure 10. Squeeze pads 17*a* and 17*b* are tapered outwardly from top wall 18 away from the center of the closure, with the squeeze pads being wider in width adjacent top wall 18 and narrowing towards the free end of the squeeze pad which is spaced from the closure top wall 18. Squeeze pads 17*a* and 17*b* intuitively compel adults to squeeze further down from the closure top wall 18, due to finger size, which increases squeeze efficiency and allows for an increased effectiveness in overcoming the safety feature of the closure. Young children tend to grip higher on the closure where the squeeze force is significantly increased and their smaller fingers are less likely to tactilely find the squeeze efficiency advantage at the base of the closure, thus making the closure more difficult for children to open.

As shown in FIGS. 4 and 7-9, container neck 2 includes at least one lug 7 disposed thereon. In one embodiment, the container neck 2 includes two lugs 7 and 8. Container lug 7 is diametrically aligned with container lug 8 along the outer surface of neck 2. However, depending on the desired range of rotation of the closure 10 about the container neck 2, the container neck 2 according to one embodiment may include one or more lugs that are disposed at various points around the container neck 2. However, an embodiment may include lugs, locks, and stops that are aligned differently so as to provide a varied range of rotation. Container neck 2 may include two child-resistant stops or faces 7*c*, 8*c* integrally formed with container lugs 7 and 8, as shown in FIGS. 4 and 7. However, another embodiment of closure 10 may also encompass child-resistant stops that are not aligned nor integrally formed with lugs 7, 8.

As shown in FIGS. 1, 1A-1C, 2, 3, and 7, pressure pads 17*a* and 17*b* are spaced about 90 degrees apart from a pair of child resistant locks 30*a* and 30*b*. Child resistant locks 30*a* and 30*b* are accordingly also diametrically opposed to each other, disposed along an inner surface of outer shell 17. Child resistant locks 30*a*, 30*b* project from top wall 18 and outer shell 17. Child resistant locks 30*a*, 30*b* will cam over container lugs 7, 8 disposed on neck 2 when closure 10 is secured onto container 1. More specifically, locks 30*a*, 30*b* will flex outwardly to travel over the cam surfaces 7*b*, 8*b* of container lugs 7, 8, locking the closure in place. Child resistant locks 30*a* and 30*b* each may have at least one inwardly tapered or curved side 33*a* and 33*b*, which facilitates passage of child resistant locks 30*a*, 30*b* past cam surfaces 7*b*, 8*b* of container lugs 7, 8 as closure 10 is rotated onto container 1. Upon further rotation of closure 10 onto neck 2 during assembly, stop lugs 40 respectively engage stop faces 7*a*, 8*a* and thus operably engage stopping mechanism 60.

As shown in FIGS. 7, 8, and 9, container lugs 7 and 8 positioned on lower container neck 2 each have a respective abutment child resistant face 7*c*, 8*c* that prevents removal of closure 10 by interferingly engaging lock engaging faces 32*a*, 32*b* on child resistant locks 30*a*, 30*b* positioned on the inside of outer shell 17. As shown in FIG. 8, when inward pressure is not applied to the squeeze pads while simultaneously turning closure 10, child resistant lock 30*a* will aggressively engage container lug 7 by flexing inwardly into the container lug along abutment child resistant face 7*c*, thus significantly increasing the child resistance of the package. In order to overcome the safety lock, inward pressure must be applied to both squeeze pads 17*a* and 17*b* to ovalize outer shell 17 while simultaneously turning closure 10. Ovalizing outer shell 17 positions locks 30*a*, 30*b* out of interference contact with abutment child resistant faces 7*c*, 8*c* and permits rotational motion and removal of closure 10.

Also shown in FIGS. 2, 3, and 7, squeeze pads 17*a* and 17*b* may be respectively aligned with a pair of stiffening webs 71, 72 and 73, 74. The two diametrically opposed pairs of stiffening webs 71, 72 and 73, 74 extend radially between and are integrally connected at their respective axially opposite ends to inner shell 16 and outer shell 17. Each pair of stiffening webs 71, 72 and 73, 74 extend downwardly from top wall 18 of closure 10. The stiffening webs may be provided in a variety of positions, quantities, constructions, and dimensions, and still permit squeeze-and-turn manipulation release of the child resistant engagement of closure 10.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A double shell closure comprising:

a closure body including a top wall with a downwardly depending outer skirt and inner skirt, said inner skirt having an inner surface facing inward toward the center of said closure body and an outer surface facing outward away from the center of said closure body;

at least one thread inwardly projecting from said inner surface of said inner skirt;

at least one stop lug outwardly projecting from said inner skirt;

a support rib extending from adjacent said stop lug upwardly towards said top wall along said outer surface of said inner skirt, wherein said support rib is one of a plurality of unscrewing ribs positioned annularly about said inner skirt; and wherein said outer skirt includes one or more child resistant locks.

2. The closure as in claim 1 wherein said support rib projects from said top wall.

3. The closure as in claim 1 wherein said support rib positioned substantially vertical along said outer surface of said inner skirt.

4. The closure as in claim 1 wherein said support rib is in engagement with outside forces being applied to said closure body during manufacture.

5. The closure as in claim 1 further including a liner positioned within said closure body.

6. The closure as in claim 5 wherein said liner includes a central portion and an outer peripheral edge, and at least one projection downwardly depends from said top wall and rigidly spaces said central portion of said liner away from said top wall while said outer peripheral edge of said liner axially travels within said closure.

7. A closure comprising:

a closure body having a top wall with a depending outer skirt and inner skirt, wherein said inner skirt having an outer surface and an inner surface;

at least one thread projecting from said inner surface of said inner skirt;

a plurality of unscrewing lugs projecting from said outer surface of said inner skirt and annularly positioned about said inner skirt;

a stop lug projecting from a distal end of said inner skirt spaced from said top wall:

at least one of said plurality of unscrewing lugs being a support rib positioned adjacent said stop lug; and a spring gap mechanism adjacent said stop lug.

8. The closure as in claim 7 wherein said support rib extends upwardly towards said top wall.

9. The closure as in claim 7 wherein said support rib projects from said top wall to said distal end of said inner skirt.

10. The closure as in claim 7 wherein each of said support rib and said stop lug having a stop face.

11. The closure as in claim 7 wherein said spring gap mechanism adjacent said stop lug permits said stop lug to travel into a portion of said spring gap.

12. The closure as in claim 7 wherein said closure is a child resistant closure.

13. The closure as in claim 7 wherein said support rib has a different shape from said other plurality of unscrewing lugs.

14. The closure as in claim 7 wherein said support rib is substantially the same shape over the length of said inner skirt.

* * * * *